US008649722B2

(12) United States Patent
Urayama et al.

(10) Patent No.: US 8,649,722 B2
(45) Date of Patent: Feb. 11, 2014

(54) PROTECTIVE AGENT SUPPLY DEVICE, PROCESS CARTRIDGE, AND IMAGE FORMING APPARATUS

(75) Inventors: Taichi Urayama, Kanagawa (JP); Kunio Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 13/287,485

(22) Filed: Nov. 2, 2011

(65) Prior Publication Data

US 2012/0141177 A1 Jun. 7, 2012

(30) Foreign Application Priority Data

Dec. 1, 2010 (JP) ..... 2010-268117

(51) Int. Cl.
*G03G 21/00* (2006.01)

(52) U.S. Cl.
USPC ..... 399/346

(58) Field of Classification Search
USPC ..... 399/346, 357
See application file for complete search history.

(56) References Cited

U.S. PATENT DOCUMENTS

| | | | | |
|---|---|---|---|---|
| 3,501,294 | A | 3/1970 | Joseph | |
| 5,349,429 | A * | 9/1994 | Jugle et al. | 399/346 |
| 6,160,977 | A * | 12/2000 | Takeichi et al. | 399/127 |
| 7,941,087 | B2 | 5/2011 | Tanaka et al. | |
| 7,979,016 | B2 | 7/2011 | Hatakeyama et al. | |
| 7,979,017 | B2 | 7/2011 | Tanaka et al. | |
| 7,991,342 | B2 | 8/2011 | Kabata et al. | |
| 2009/0196665 | A1 | 8/2009 | Tanaka et al. | |
| 2009/0285613 | A1 | 11/2009 | Nakai et al. | |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0052287 | A1 * | 3/2011 | Kashiwakura et al. | 399/346 |

FOREIGN PATENT DOCUMENTS

| | | |
|---|---|---|
| JP | 51-22380 | 7/1976 |
| JP | 2001-305907 | 11/2001 |
| JP | 2006-350240 | 12/2006 |
| JP | 2007-293240 | 11/2007 |
| JP | 2009-150986 | 7/2009 |
| JP | 2009-169237 | 7/2009 |
| JP | 2010-164759 | 7/2010 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A novel protective agent supply device is provided including a protective agent block including a metal salt of a fatty acid; a rotatable foamed roller having a foamed layer having open cells, that is in continuous contact with both the protective agent block and an outer peripheral surface of an image bearing member that bears a toner image, and that scrapes the protective agent block and supplies the scraped protective agent to the outer peripheral surface of the image bearing member during rotation of the foamed roller; and a pressing unit that presses the protective agent block against the foamed roller.

20 Claims, 4 Drawing Sheets

PROTECTIVE AGENT SUPPLY DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. §119 to Japanese Patent Application No. 2010-268117, filed on Dec. 1, 2010, in the Japanese Patent Office, the entire disclosure of which is hereby incorporated herein by reference.

FIELD OF THE INVENTION

The present invention relates to a protective agent supply device that supplies a protective agent to an image bearing member for use in electrophotographic image forming apparatuses such as printers, facsimile machines, and copiers.

BACKGROUND OF THE INVENTION

Electrophotographic image forming apparatuses are of two types: direct transfer types and indirect transfer types. In direct transfer types, an electrostatic latent image formed on an image bearing member (either drum-shaped or endless-belt-shaped), such as a photoreceptor, is developed into a toner image with the charged toner particles, and the toner image is then directly transferred from the image bearing member onto a sheet-like material, such as copy paper, resin sheets, thick paper, and postcards, on which toner images are fixable. In indirect transfer types, the toner image is transferred from the image bearing member onto an intermediate transfer member (either drum-shaped or endless-belt-shaped) first, and then transferred onto the sheet-like material. The sheet-like materials are hereinafter collectively referred to as "paper" for convenience. Typically, but not necessarily, paper is the medium from which is made a sheet on which an image is to be formed. Other printable media is available in sheets and their use here is included.

In both direct and indirect transfer types, some toner particles remain on the image bearing member without being transferred onto paper. Such residual toner particles are typically scraped off with a blade-like cleaning member or electrically removed with a charging member (e.g., a charging roller) by applying an electric field having the opposite polarity to the toner particles. This process is hereinafter referred to as "cleaning process".

The image bearing member, cleaning member, and charging member are subjected to physical and electrical stresses in the cleaning process, resulting in abrasion and deterioration of these members. To solve this problem, various attempts have been made.

For example, Examined Japanese Patent Application Publication No. 51-22380 proposes forming a lubricative film with zinc stearate on the outermost surface of an image bearing member so as to protect the image bearing member from abrasion with a cleaning member.

Unexamined Japanese Patent Application Publication No. 2001-305907 also proposes forming a lubricative film on the outermost surface of an image bearing member. The lubricative film is formed in a way in which a brush roller scrapes a solid lubricant and supplies the scraped powdered lubricant to the outermost surface of an image bearing member. The supplied lubricant is evened out with a blade so that the resulting lubricative film has a uniform thickness which prevents the production of defective images.

Because the solid lubricant is pressed against the brush roller with a spring, there is a problem that the pressing force of the spring gradually weakens and the amount of the protective agent supplied gradually reduces as the solid lubricant is consumed.

Unexamined Japanese Patent Application Publication No. 2007-293240 attempts to solve this problem and provides a lubricant applicator that is able to supply a constant amount of lubricant to an image bearing member regardless of the degree of consumption of the solid lubricant. Also, Unexamined Japanese Patent Application Publication Nos. 2001-305907 and 2007-293240 both describe that zinc stearate is preferable for the lubricant.

The image bearing member is also subjected to electrical stresses when being charged (hereinafter "charging process"), notably by contact charging or proximity charging that causes electrical discharge. Contact or proximity charging has a problem that various active species and reactive products, to be adsorbed to the surface of the image bearing member, generate due to electrical discharge.

In the charging process, zinc stearate behaves as a suitable lubricant for protecting the surface of the image bearing member from electrical stress. However, in the cleaning process, zinc stearate undesirably allows toner particles to slip through the blade-like cleaning member due to its lubricity. This results in deterioration of not only the cleaning member but also the resulting image quality. Moreover, toner particles having slipped through the cleaning blade contaminate the charging member, resulting in production of defective images. Sipping though the blade-like cleaning member is more likely to occur when the toner shape is more spherical.

There is another problem that zinc stearate is likely to deteriorate by electrical stress. Deteriorated zinc stearate has no more lubricity and accelerates slipping through of toner particles and contamination of the charging member. In view of this, Unexamined Japanese Patent Application Publication No. 2006-350240 proposes a mixture lubricant comprised of zinc stearate (i.e., a metal salt of a fatty acid) with boron nitride (i.e., an inorganic lubricant) that does not degrade its lubricity even under electrical stress.

One typical method of forming powdered lubricant into solid block includes melt molding. When a mixture lubricant including about the same amounts of zinc stearate and boron nitride is subjected to melt molding, the resulting solid block is too hard to be scraped off. This problem can be solved by forming solid block by compression molding. Alternatively, reducing the content ratio of boron nitride in the mixture lubricant is effective for reducing the hardness of the resulting solid block, while the content ratio of boron nitride correlates with the degree of contamination of the charging member. The smaller the content ratio of boron nitride, the worse the degree of contamination of the charging member.

Unexamined Japanese Patent Application Publication Nos. 2009-150986 and 2009-169237 each disclose a lubricant applicator in which a solid lubricant formed by melt-molding zinc stearate is scraped off by a closed-cell foam roller. The scraped solid lubricant is formed into particles having a relatively small and uniform particle size, which can form a uniform protective layer on an image bearing member.

However, this lubricant applicator has not solved the problem of deterioration of zinc stearate under electrical stress that accelerates slipping through of toner particles and contamination of the charging member. In addition, when the closed-cell foam roller keeps contacting both the image bearing member and the solid lubricant for an extended period of time, it is likely that the closed-cell foam roller causes distortion because closed-cell foams generally cause greater compressive residual distortion than open-cell foams.

SUMMARY OF THE INVENTION

Exemplary aspects of the present invention are put forward in view of the above-described circumstances, and provide a novel protective agent supply device that supplies a constant amount of a protective agent to an image bearing member for an extended period of time to reliably protect the image bearing member from abrasion, toner filming, and contamination.

In one exemplary embodiment, a novel protective agent supply device includes a protective agent block including a metal salt of a fatty acid; a rotatable foamed roller having a foamed layer having open cells, that is in continuous contact with both the protective agent block and an outer peripheral surface of an image bearing member that bears a toner image, and that scrapes the protective agent block and supplies the scraped protective agent to the outer peripheral surface of the image bearing member during rotation of the foamed roller; and a pressing unit that presses the protective agent block against the foamed roller.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
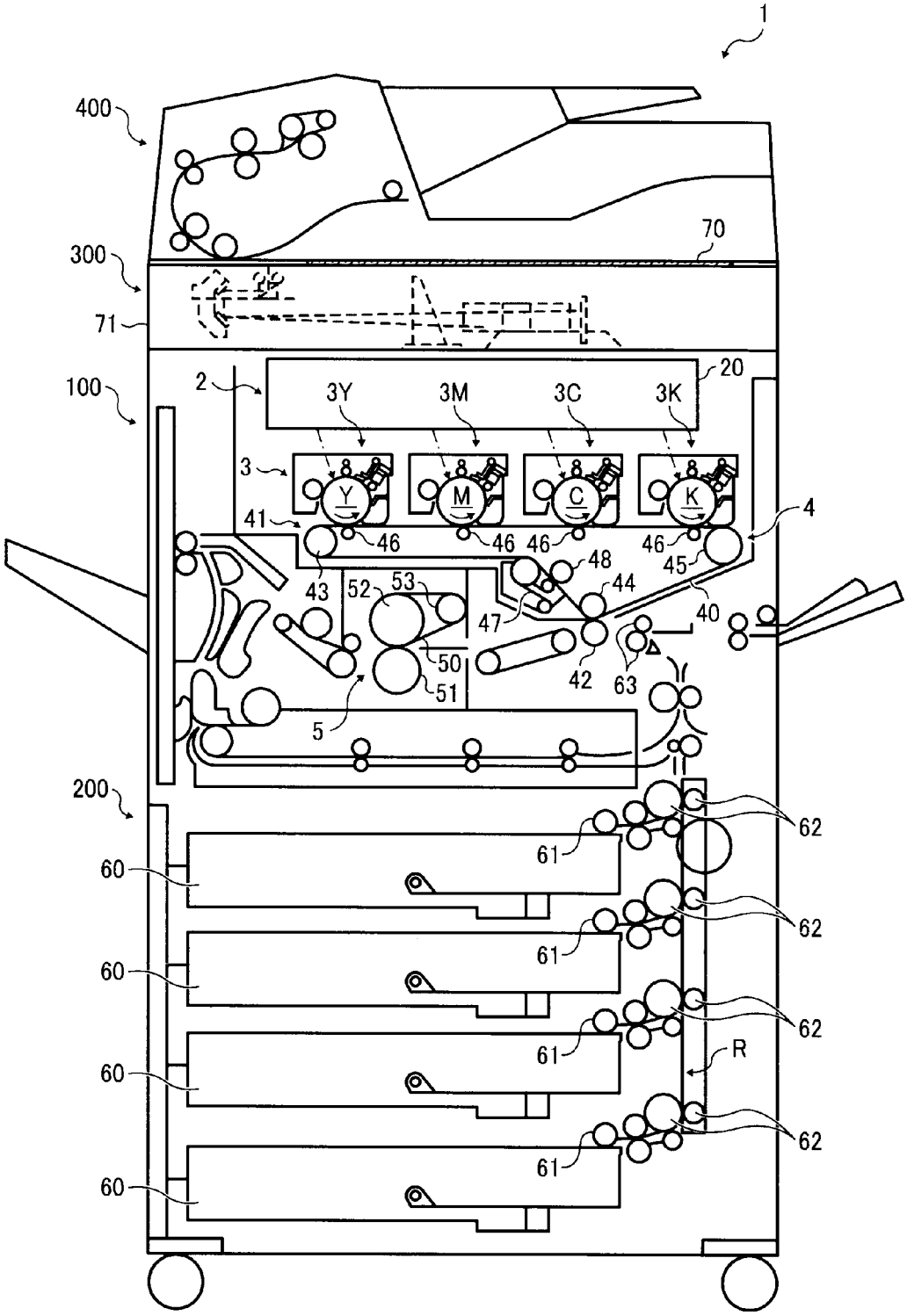
FIG. 1 is a perspective elevation view illustrating an image forming apparatus according to exemplary embodiments of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a perspective elevation view illustrating an image forming apparatus according to exemplary embodiments of the invention. An image forming apparatus 1 employs a tandem intermediate transfer method that forms full-color images with four color toners of yellow, magenta, cyan, and black. The image forming apparatus 1 includes a printer 100, a paper feeder 200 provided below the printer 100, a scanner 300 provided above the printer 100, and an automatic document feeder 400 provided above the scanner 300.

The printer 100 includes an irradiating unit 2 that writes electrostatic latent images on photoreceptors, an imaging unit 3 that develops the electrostatic latent images into toner images, a transfer unit 4 that transfers the toner images onto paper, and a fixing unit 5 that fixes the toner images on the paper.

The irradiating unit 2 includes an irradiator 20 including a laser light source (e.g., laser diode (LD), light-emitting diode (LED)), a rotatable polygon mirror, and an fθ lens. A laser light beam emitted from the laser light source is deflected and/or collected by the polygon mirror and/or the fθ lens and scans the outer peripheral surfaces of the photoreceptors which have been uniformly charged to a predetermined polarity, thus attenuating charge level of the photoreceptors.

The imaging unit 3 includes four process cartridges 3Y, 3M, 3C, and 3K including respective photoreceptors Y, M, C, and K serving as image bearing members and respective toners of yellow, magenta, cyan, and black.

The transfer unit 4 includes an intermediate transfer unit 41 including an intermediate transfer belt 40, and a secondary transfer device 42 provided below the intermediate transfer unit 41. The intermediate transfer unit 41 sequentially transfers toner images of yellow, magenta, cyan, and black from the respective photoreceptors Y, M, C, and K onto the intermediate transfer belt 40 to form a composite toner image thereon. The secondary transfer device 42 transfers the composite toner image from the intermediate transfer belt 40 onto paper.

The intermediate transfer belt 40 is comprised of a seamless belt having a multilayer structure having a semiconductive resin base and a releasing layer. The transfer unit 4 further includes support rollers 43, 44, and 45 that support and stretch the intermediate transfer belt 40, and primary transfer rollers 46 each facing the photoreceptors Y, M, C, and K with the intermediate transfer belt 40 therebetween.

The intermediate transfer belt 40 is conductive. Preferably, the intermediate transfer belt 40 has a volume resistivity of $10^5$ to $10^{11}$ Ω·cm. When the volume resistivity is too small, toner images may be disturbed when being transferred from the photoreceptors Y, M, C, and K onto the intermediate transfer belt 40 due to the occurrence of electric discharge. When the volume resistivity is too large, toner images may be transferred from the intermediate transfer belt 40 while leaving opposite charge thereon, thereby causing residual image in the next image.

The intermediate transfer belt 40 may be formed by, for example, kneading a thermoplastic resin with one or more of metal oxides (e.g., tin oxide, indium oxide) and conductive particles or polymers (e.g., carbon black), and extrusion-molding the kneaded mixture into a belt or a cylinder. Alternatively, the intermediate transfer belt 40 may be formed by centrifugally molding a resin liquid comprising a thermally-crosslinkable monomer or oligomer and optional conductive particles or polymers into a seamless belt while being heated.

The support roller 43 is driven to rotate by a drive force transmitted from a drive motor. Thus, the support roller 43 serves as a drive roller that rotates the intermediate transfer belt 40 clockwise in FIG. 1. The support rollers 44 and 45 are driven to rotate by the rotation of the intermediate transfer belt 40.

Each primary transfer roller 46 is provided slightly downstream from the position definitely opposite to each photoreceptor Y, M, C, or K relative to the direction of movement of the intermediate transfer belt 40, thus forming a gap within which electric discharge can occur. The primary transfer rollers 46 are connected to a power source and apply a primary transfer bias by contact with the intermediate transfer belt 40. The primary transfer rollers 46 can arbitrarily contact or separate from an inner peripheral surface of the intermediate transfer belt 40 by a contact/separation mechanism. The contact/separation mechanism presses the primary transfer rollers 46 against the respective photoreceptors Y, M, C, and K with the intermediate transfer belt 40 therebetween so as to form primary transfer nips. In each primary transfer nip, a toner image is transferred from each photoreceptor onto an outer peripheral surface of the intermediate transfer belt 40 by Coulomb's force while a transfer electric field is formed by application of the primary transfer bias having the opposite polarity to the toner image.

In the present embodiment, the secondary transfer device 42 is in the form of roller (hereinafter "secondary transfer roller 42"). The secondary transfer roller 42 is pressed against the support roller 44 with the intermediate transfer belt 40 therebetween so as to form a secondary transfer nip. The secondary transfer roller 42 is connected to a power source and applies a secondary transfer bias having the opposite polarity to the toner image to the secondary transfer nip by contact with the intermediate transfer belt 40. The secondary transfer device 42 may be alternatively in the form of charger which applies a transfer bias without contact with the intermediate transfer belt 40.

A cleaning unit 47 is provided facing a bended portion of the intermediate transfer belt 40 between the drive roller 43 and the support roller 44. The cleaning unit 47 removes residual toner particles remaining on the outer peripheral surface of the intermediate transfer belt 40 in cooperation with a backup roller 48 provided inside the intermediate transfer belt 40. The residual toner particles collected by the cleaning unit 47 are conveyed to a waste toner tank by a conveyer.

The fixing unit 5 includes a seamless fixing belt 50 and a pressing roller 51 pressed against the fixing belt 50 by a biasing unit. The fixing belt 50 is stretched between a fixing roller 52 and a heating roller 53. The fixing roller 52 drives the fixing belt 50 to rotate. The heating roller 53 internally contains a halogen heater. The fixing belt 50 and the pressing roller 51 are in intimate contact with each other, thus forming a fixing nip. The toner image having been transferred onto paper by the transfer unit 4 is conveyed to the fixing nip and melted by application of heat and pressure, thus fixing the toner image on the paper.

The paper feeder 200 includes multiple paper feed cassettes 60 vertically located over one another. Each paper feed cassette 60 stores multiple sheets of paper having a predetermined size. In each paper feed cassette 60, a paper feed roller 61 elastically contacts a top sheet of the paper and feeds it toward a paper feed path R by rotation. On the paper feed path R, multiple pairs of feed rollers 62 are provided at an interval corresponding to the minimum size of the paper. A pair of registration rollers 63 is provided immediately upstream from the secondary transfer nip. The pair of registration rollers 63 feeds the paper sheet to the secondary nip in synchronization with an entry of a toner image into the secondary nip.

The scanner 300 includes a contact glass 70 and an optical reader 71 that reads a document put on the contact glass 70. The optical reader 71 includes a movable optical system including a movable light source and a movable mirror. The light source directs light to the document and the reflected light is formed into an image through the mirror, an imaging lens, and an image reading element (e.g., CCD). The image thus read is transformed into an electrical signal to be transmitted to a controller of the image forming apparatus.

The automatic document feeder 400 is openable and closable with respect to the upper surface of the contact glass 70, in other words, is capable of exposing or shielding the upper surface of the contact glass 70. The automatic document feeder 400 automatically feeds a document onto the contact glass 70, and the document on the contact glass 70 is read by the optical reader 71 in the scanner 300.

Figure 2:
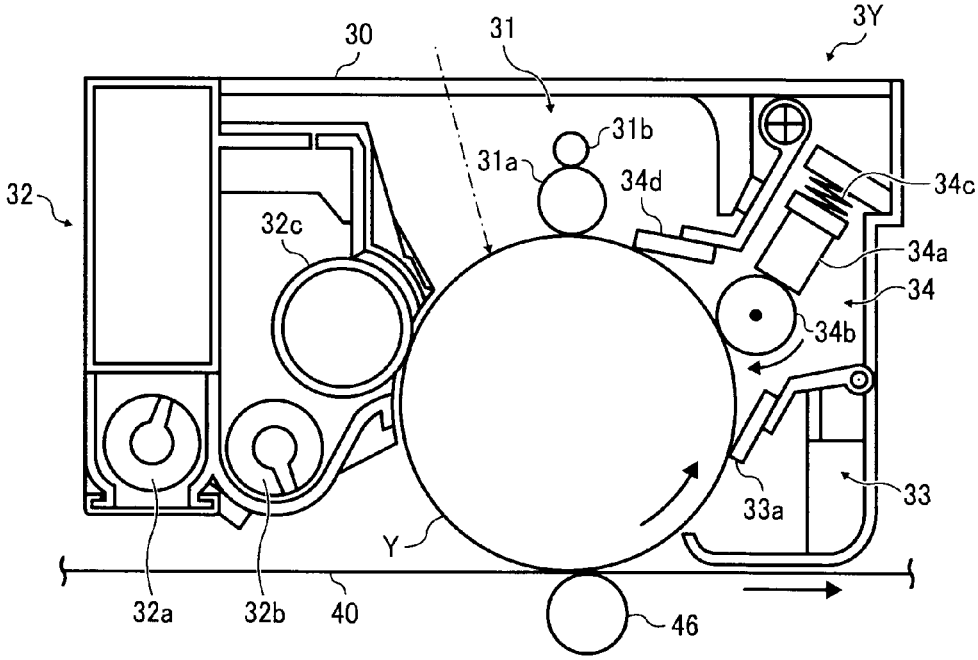
FIG. 2 is a vertical cross-sectional view illustrating the process cartridge included in the image forming apparatus illustrated in FIG. 1

FIG. 2 is a vertical cross-sectional view illustrating the process cartridge 3Y. Because the process cartridges 3Y, 3M, 3C, and 3K have the same configuration, only the process cartridge 3Y is illustrated. In the following descriptions, the additional character Y representing toner color of yellow may be added or omitted for the sake of simplicity.

The process cartridge 3Y includes a main body 30 detachably attachable to the image forming apparatus 1; the photoreceptor Y rotatably provided inside the main body 30; and a charger 31, a developing device 32, a cleaning device 33, and a protective agent supply device 34 each provided around the photoreceptor Y.

The charger 31 includes a charging roller 31*a* and a cleaning roller 31*b*. The charging roller 31*a* uniformly charges the outer peripheral surface of the photoreceptor Y while being rotated by rotation of the photoreceptor Y. The cleaning roller 31*b* applies a voltage having the same polarity to the toner particles to the charging roller 31*a* so as to remove toner particles adhered to the charging roller 31*a* by electrostatic repulsion. The charging roller 31*a* may be replaced with another charging member capable of charging the photoreceptor Y without contact therewith. The cleaning roller 31*b* may be replaced with a blade-like member capable of removing adhered toner particles by contact with the charging roller 31*a*.

The developing device 32 includes two agitation-conveyance rollers 32*a* and 32*b* and a development roller 32*c*. The agitation-conveyance rollers 32*a* and 32*b* agitate a two-component developer comprised of a toner and a magnetic carrier to charge the toner while conveying the two-component developer to the development roller 32*c*. The development roller 32*c* is comprised of a magnet roller having multiple magnetic poles and a rotatable development sleeve provided around the magnet roller. The two-component developer is borne on the outer peripheral surface of the development sleeve owing to magnetic force from the magnet roller, and is conveyed to a developing area by rotation of the development sleeve. Upon entry of the two-component developer into the developing area, a developing bias is applied thereto so that the toner is transferred onto an electrostatic latent image that has been formed on the photoreceptor Y by the irradiator 20.

The cleaning device 33 includes a cleaning blade 33*a* comprised of an elastic body such as urethane rubber, epichlorohydrin rubber, silicone rubber, and fluorine rubber. A leading edge of the cleaning blade 33*a* faces the direction of rotation of the photoreceptor Y so as to scrape off residual toner particles remaining on the photoreceptor Y without being transferred. Details of the protective agent supply device 34 will be described later.

Operations of the image forming apparatus 1 are described below with reference to FIGS. 1 and 2. In process cartridges 3Y, 3M, 3C, and 3K, first, the peripheral surface of the respective photoreceptors Y, M, C, and K are charged to a predetermined polarity by the charger 31, and subsequently irradiated with a laser light beam containing image information emitted from the irradiating unit 2 so that the surface potential at the irradiated portions of the photoreceptors Y, M, C, and K are reduced to form electrostatic latent images. The developing device 32 develops each electrostatic latent image into a toner image that is visible. Each toner image is conveyed to the primary transfer nip by rotation of the photoreceptor Y, M, C, and K and then transferred onto the intermediate transfer belt 40 by the Coulomb's force upon application of a primary transfer bias from the primary transfer roller 46. Residual toner particles remaining on the photoreceptors Y, M, C, and K after the primary transfer are removed by the cleaning device 33. Thus, the photoreceptors Y, M, C, and K get ready for the next image forming operation.

Toner images of yellow, magenta, cyan, and black thus formed in the respective process cartridges 3Y, 3M, 3C, and 3K are sequentially transferred in this order onto the intermediate transfer belt 40 in synchronization with rotation of the intermediate transfer belt 40, resulting in formation of a composite toner image in which the toner images of yellow, magenta, cyan, and black are superimposed on one another.

At the same time, a sheet of paper fed from the paper feeder 200 via the paper feed path R is once stopped at the pair of registration rollers 63 and fed to the secondary transfer nip in synchronization with an entry of the composite toner image into the secondary transfer nip. In the secondary transfer nip, the secondary transfer device 42 applies a secondary transfer bias so that the composite toner image is electrostatically attracted toward the secondary transfer device 42 from the intermediate transfer belt 40. The sheet of paper onto which the composite toner image has been transferred is conveyed to the fixing nip in the fixing unit 5, and the toner image is fixed on the sheet of paper upon application of heat and pressure. Residual toner particles remaining on the intermediate transfer belt 40 after the secondary transfer are removed by the cleaning unit 47. Thus, the intermediate transfer belt 40 gets ready for the next image forming operation. The residual toner particles removed by the cleaning unit 47 are fed to a waste toner tank.

Details of the protective agent supply device 34 are described below with reference to FIGS. 2 to 6. As illustrated in FIG. 2, the protective agent supply device 34 includes a protective agent block 34*a*, a foamed roller 34*b*, a pressing unit 34*c*, and a leveling blade 34*d*. The protective gent block 34*a* is comprised of a protective agent that covers and protects the outer peripheral surface of the photoreceptor Y. The foamed roller 34*b* is in contact with both the protective agent block 34*a* and the photoreceptor Y so that the foamed roller 34*b* scrapes off the protective agent block 34*a* and applies the scraped powdered protective agent to the peripheral surface of the photoreceptor Y. The pressing unit 34*c* presses the protective agent block 34*a* against the foamed roller 34*b*. The leveling blade 34*d* evens out the powdered protective agent applied to the peripheral surface of the photoreceptor Y to form a thin layer thereof.

Figure 3:
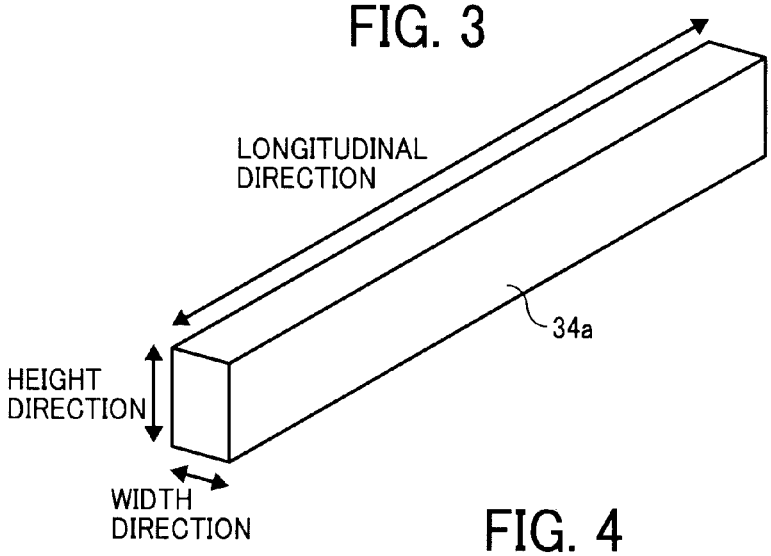
FIG. 3 and FIG. 4 are perspective and vertical cross-sectional views, respectively, illustrating the protective agent block included in the process cartridge illustrated in FIG. 2.
Figure 4:
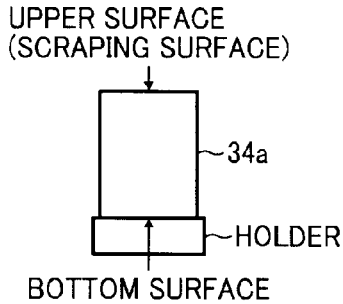

FIG. 3 and FIG. 4 are perspective and vertical cross-sectional views, respectively, illustrating the protective agent block 34*a*. The protective agent block 34*a* is formed by compression-molding a protective agent comprising a metal salt of a fatty acid into a rectangular cylinder, the longitudinal axis of which is parallel to the axis of the foamed roller 34*b*. The shape of the protective agent block 34*a* is not limited to the rectangular cylinder, and may be in the form of polygonal or circular cylinder, the longitudinal axis of which is parallel to the axis of the foamed roller 34*b*.

Specific examples of usable metal salts of fatty acids include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, and cadmium ricinoleate. Two or more of these materials can be used in combination. To effectively prevent the image bearing member form being contaminated with toner, metals salts of stearic acids are preferable, and zinc stearate is most preferable.

The protective agent block 34*a* may further comprise an inorganic lubricant for the purpose of improving resistance to electrical stress. Specific examples of usable inorganic lubricants include, but are not limited to, mica, boron nitride, molybdenum disulfide, tungsten disulfide, talk, kaolin, montmorillonite, calcium fluoride, graphite, and any other materials which express lubricity by causing cleavage or inner slippage. Two or more of these materials can be used in combination. Among these materials, boron nitride is most preferable because of having a structure in which atoms are tightly bonded into a hexagonal network planar layer and each layer is bonded with another layer with a weak van der Waals force. Such layers easily cause cleavage.

The mixing ratio of the metal salt of a fatty acid to the inorganic lubricant is preferably 90/10 to 60/40. When the ratio of the metal salt of a fatty acid is too small, it may be difficult to form a reliable protective layer on the surface of an image bearing member. Mixing the inorganic lubricant is optional but preferred because the inorganic lubricant can prevent the protective agent from being damaged by electrical stress.

The protective agent block 34*a* is preferably formed by compression molding. The protective agent block 34*a* preferably has a filling rate of 84 to 95%. The filling rate is defined as a ratio of an ideal density of the protective agent before being compression-molded to an actual density of the protective agent after being compression-molded. A protective agent block having too small a filling rate may easily cause fracture due to its poor mechanical strength. It is difficult to prepare a protective agent block having too large a filling rate because it requires an extremely large pressing force which is beyond the ability of typical pressing machines or causes fracture in the process of pressing. On the other hand, typically, a protective agent block formed by melt molding has a filling rate of 100%.

Figure 5:
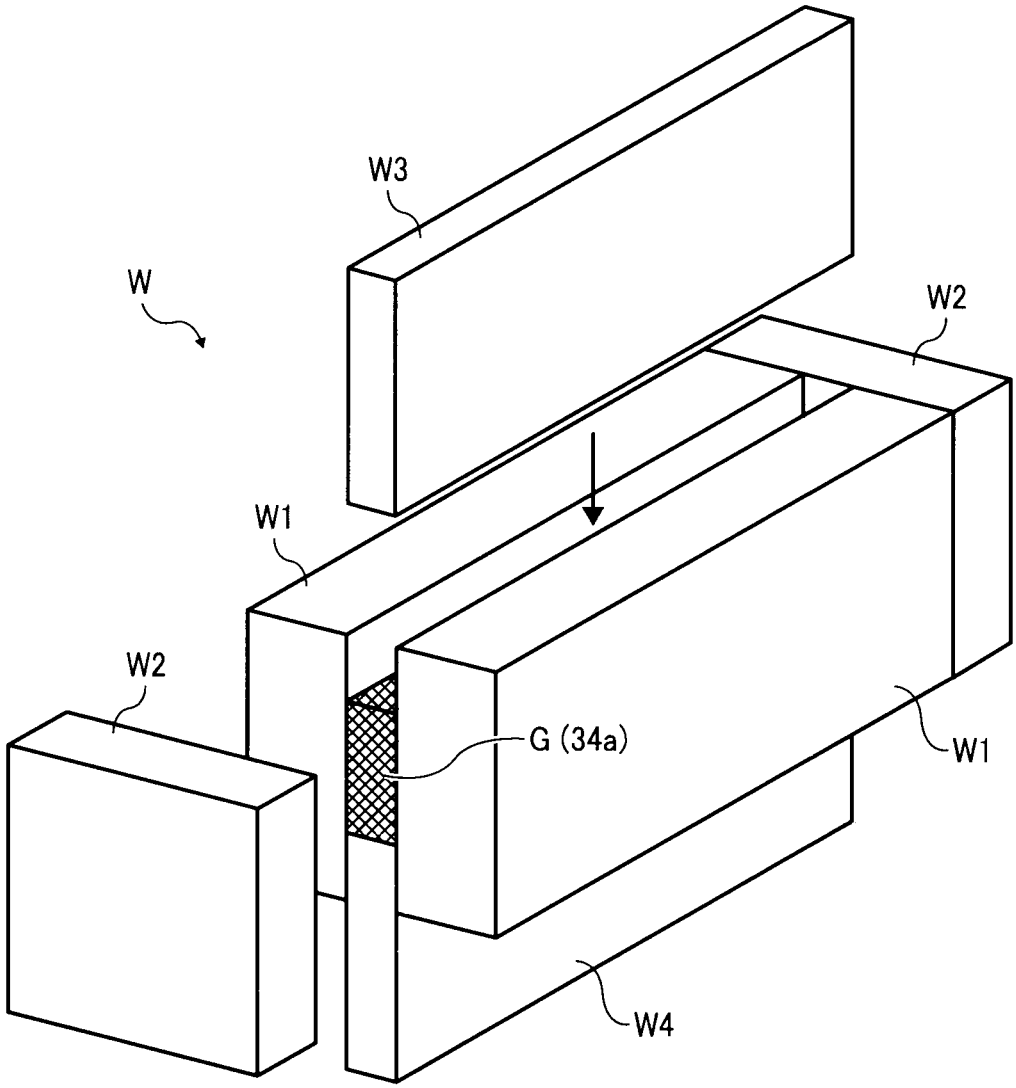
FIG. 5 and FIG. 6 are perspective and vertical cross-sectional views, respectively, illustrating a mold form for preparing the protective agent block illustrated in FIG. 3 and FIG. 4 by compression molding.
Figure 6:
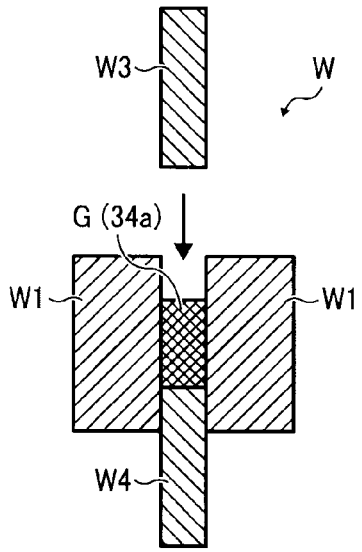

FIG. 5 and FIG. 6 are perspective and vertical cross-sectional views, respectively, illustrating a mold form for preparing the protective agent block 34*a* by compression molding.

A mold form W is comprised of a pair of longitudinal frames W1, a pair of end frames W2, an upper frame W3, and a bottom frame W4. A powdery (including sandy and granular) raw material G is poured in the mold form W and slightly pressed by the upper frame W3. After pouring a small and equivalent amount of additional raw material G in the mold form W from both ends while removing the end frames W2, the raw material G is finally pressed by the upper frame W3. Thus, the raw material G is molded into a protective agent block in which the filling rate at the end regions are higher than that at the center region. Such a protective agent block having a higher filling rate at the end regions is not likely to be abraded from only one end. Alternatively, division plates that divide the center region and the end regions may be provided within the mold form W. In this case, the greater amount of raw material G is poured in the end regions than in the center region. After removing the division plates, the raw material G is finally pressed by the upper frame W3, thus preparing a protective agent block having a higher filling rate at the end regions than at the center region.

Of course, the protective agent block 34*a* may be formed by typical melt molding in which raw materials are melted by heating and molded into a desired shape by subsequent cooling. In this case, as described above, an appropriate amount of an inorganic lubricant is preferably mixed in the protective agent so as not to make the resulting protective agent block too hard and not to cause contamination of the charging member.

Figure 7:
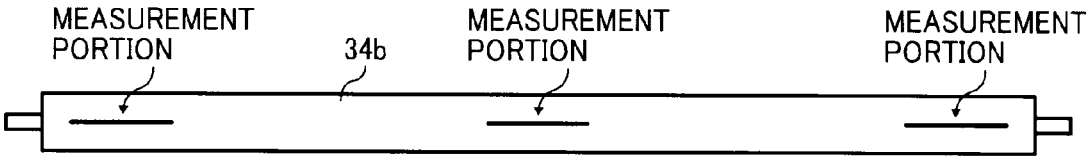
FIG. 7 is a plan view illustrating the foamed roller included in the process cartridge illustrated in FIG. 2.

FIG. 7 is a plan view illustrating the foamed roller 34*b*. The foamed roller 34*b* is comprised of a core material and a foamed layer provided around the core material. The foamed roller 34*b* is in contact with the outer peripheral surfaces of both the protective agent block 34*a* and the photoreceptor Y. The foamed roller 34*b* rotates to scrape off the protective agent block 34*a* and to apply the scraped powdered protective agent to the peripheral surface of the photoreceptor Y.

The core material is a round bar comprised of a metal (e.g., iron, aluminum, stainless steel) or a resin (e.g., epoxy resin, phenol resin), for example. Materials, shape, size, and structure of the core material are not particularly limited as long as the core material has a sufficient strength for use in the foamed roller 34*b*.

Preferably, the foamed layer constituting the outermost layer of the foamed roller 34*b* has open cells in an amount of 25 to 300 per inch and a hardness of 50 to 500 N. The foamed roller 34*b* may optionally include other layers such as an elastic layer other than the foamed layer. The foamed layer is preferably comprised of polyurethane foam in terms of availability and cost. In comparison to the exemplary foamed layer having open cells, foamed layers having closed cells are not preferable because they are likely to cause plastic deformation. The deformed foamed layer cannot reliably apply the protective agent to the photoreceptor.

The foamed roller 34*b* may be prepared by, for example, (1) forming a blockish polyurethane foam from raw materials, cutting a cylindrical polyurethane foam out of the blockish polyurethane foam, grinding the surface of the cylindrical polyurethane foam so that the surface thereof has open cells, and inserting the core material in the cylindrical polyurethane foam, or (2) pouring raw materials in a mold within which the core material is set, and subject the raw materials to foaming. The method (2) is more preferably because the polyurethane foam layer and the open cells can be simultaneously formed with a high processing accuracy. The core material may have an adhesive layer so that the foamed layer can easily adhere thereto. The mold may have a fluororesin coating so that the polyurethane foam can easily release therefrom.

The polyurethane foam may be formed by, for example, mixing a polyol and a polyisocyanate with additives (e.g., a catalyst, a foaming agent, a foam stabilizer) to induce a foaming reaction. Materials other than the polyisocyanate are previously mixed, and the polyisocyanate is added to the resulting mixture immediately before the mixture is subjected to molding.

Specific examples of usable polyols include, but are not limited to, polyether polyols and polyester polyols. Polyether polyols are more preferable in terms of processability and ease of control in hardness of the resulting foamed layer. Specific examples of suitable polyether polyols include, but are not limited to, polyether polyether polyol, polyester polyether polyol, and polymer polyether polyol. Two or more of these materials can be used in combination. Additionally, polyether polyether polyols having terminal ethylene oxides in an amount of 5% by mol or more are also preferable in terms of moldability.

A mixture of a polytetramethylene ether glycol with an ethylene and propylene oxides adduct polyether polyol, preferably having a mixing ratio of 95/5 to 20/80, is also preferable.

Specific examples of usable polyisocyanates include, but are not limited to, 2,4- or 2,6-tolylene diisocyanate (TDI), tolylene diisocyanate (TODI), naphthylene diisocyanate (NDI), xylylene diisocyanate (XDI), 4,4'-diphenylmethane diisocyanate (MDI), carbon diimide-modified MDI, polymethylene polyphenyl polyisocyanate, and polymeric polyisocyanate. Two or more of these materials can be used in combination.

Specific examples of usable catalysts include, but are not limited to, (1) amine-based catalysts such as triethylene diamine, dimethyl ethanolamine, and bis(dimethylamino)ethyl ether; (2) organic metal catalysts such as dioctyl tin or distearyl tin dibutyrate; (3) modification products of (1) and (2); and (4) reactive catalysts having an active hydrogen (e.g., dimethylamino ethanol). The width of cell walls, diameter of open cells, hardness, and aeration of the polyurethane foam layer can be control by the kind and amount of the catalyst selected.

Specific preferred examples of suitable foam stabilizers include, but are not limited to, silicone-based surfactants. Specific preferred examples of suitable foaming agents include, but are not limited to, water, low-boiling-point materials, gases, and combinations thereof. Water is most preferable from the environmental viewpoint. The width of cell walls, diameter of open cells, hardness, and aeration of the polyurethane foam layer can be control by the kind and amount of the foaming agent selected. The foamed roller according to exemplary embodiments is comprised of a polyurethane foam having a predetermined amount of open cells, within which air is movable, and a predetermined hardness.

The foamed roller having open cells can be prepared as follows. First, raw materials of a polyurethane are mechanically agitated by a mixer while introducing nitrogen gas or dried air, thus preparing a raw material foamed polyurethane having a foamed density of 0.5 g/cm$^3$. A cylindrical metal mold within which a shaft is set coincident with its axis is preliminarily heated to 60° C. and then filled with the above-prepared raw material foamed polyurethane. The cylindrical metal mold is sealed and kept heated at 110° C. for 30 minutes so that the raw material foamed polyurethane is subjected to hardening. The resulting layer integrally formed with the shaft is demolded. Finally, the layer is subjected to a crushing process in which a roller compresses the layer so as to prevent contraction in cooling and to transform closed cells into open cells. Thus, a foamed roller having a foamed layer comprising a polyurethane foam having open cells is prepared.

The raw materials of a polyurethane may include, for example, 24.6 parts by weight of a polyisocyanate, 60 parts by weight of a polyether polyol, 40 parts by weight of a polytetramethylene ether glycol, 4 parts by weight of a silicone foam stabilizer, 5 parts by weight of a black colorant, 0.4 parts by weight of an electrolyte, and 0.01 parts by weight of a catalyst. In case the raw materials have too high an isocyanate index, the resulting polyurethane foam is likely to have closed cells.

The raw materials of a polyurethane foam may be further mixed with additives such as a cross-linking agent and/or a foam breaker that controls formation of open cells, and a conductive agent and/or a charge preventing agent that controls conductivity. Additionally, flame retardants, viscosity reducing agents, pigments, stabilizers, colorants, antistaling agents, ultraviolet absorbers, and antioxidants may be optionally added. Specific examples of usable cross-linking agents include, but are not limited to, triethanolamine and diethanolamine. The content of the cross-linking agent is preferably 5% by weight or less, more preferably 3% by weight or less, based on the raw materials. Too small an amount of the cross-linking agent cannot effectively form a cross-linking structure. When the amount of the cross-linking agent is too large, it may be difficult to control the cross-linking reaction.

As illustrated in FIG. 2, the pressing unit 34*c* includes a support integrated with the main body 30, a spring that presses the protective agent block 34*a* against the foamed roller 34*b* by the reactive force from the support, and a holder that stores the protective agent block 34*a*.

The leveling blade 34*d* is comprised of an elastic body such as urethane rubber, epichlorohydrin rubber, silicone rubber, and fluorine rubber. A leading edge of the leveling blade 34*d* trails the photoreceptor Y so that the powdered protective agent applied to the outer peripheral surface if the photoreceptor Y is evened out.

The leading edge of the leveling blade 34*d* which is in contact with the photoreceptor Y may by coated or impregnated with a low-frictional-coefficient material to have an improved abrasion resistance. The leveling blade 34*d* may further includes an organic or inorganic filler to have an appropriate hardness.

The leveling blade 34*d* preferably has a thickness of 0.5 to 5 mm, and more preferably 1 to 3 mm. The leveling blade 34*d* preferably has a protrusion length of 1 to 15 mm, and more preferably 2 to 10 mm.

The above-described blade members, such as the leveling blade 34*a* and the cleaning blade 33*a*, may be alternatively formed from an elastic metal blade support, the surface of which is coated or dipped with an elastic body (e.g., an elastic resin, a rubber, an elastomer) through the intermediary of a coupling agent or a primer. The blade members may be further subjected to heat hardening or surface grinding.

The elastic metal blade preferably has a thickness of 0.05 to 3 mm, and more preferably 0.1 to 1 mm. In order to prevent the blade from twisting, the blade may be bent in the direction substantially parallel to the axis after being installed.

Specific examples of the elastic body for coating the elastic metal blade include, but are not limited to, fluorine-based resins (e.g., PFA, PTFE, FEP, PVdF), fluorine-based rubbers, and silicon-based elastomers (e.g., methylphenyl silicone elastomer). These materials are optionally used in combination with a filler.

Preferably, the leveling blade 34*d* and the photoreceptor Y are in contact with each other at a line pressure of 0.49 to 7.85 N/mm (i.e., 5 to 80 gf/cm), and more preferably 0.98 to 5.88 N/mm (i.e., 10 to 60 gf/cm).

Having generally described this invention, further understanding can be obtained by reference to certain specific examples which are provided herein for the purpose of illustration only and are not intended to be limiting.

As shown in Table 1 below, in Examples 1 to 17, foamed rollers having various numbers of open cells and hardness were used in combination with protective agent blocks having various compositions. In Comparative Examples 1 to 6, foamed rollers having various numbers of closed cells and hardness were used in combination with a certain protective agent comprised of zinc stearate and boron nitride. They were subjected to evaluation of the degree of contamination of the photoreceptor and the charging roller. The details are described below.

TABLE 1

| | Foamed roller | | | Protective agent block | | Contamination | |
|---|---|---|---|---|---|---|---|
| | Cell type | Number of cells (per inch) | Hardness (N) | Composition | Molding method | Photoreceptor | Charging roller |
| Example 1 | Open cells | 25 | 147 | Zinc stearate + Boron nitride | Compression | B | A |
| Example 2 | Open cells | 70 | 147 | Zinc stearate + Boron nitride | Compression | A | A |
| Example 3 | Open cells | 80 | 53 | Zinc stearate + Boron nitride | Compression | B | A |
| Example 4 | Open cells | 240 | 91 | Zinc stearate + Boron nitride | Compression | B | A |
| Example 5 | Open cells | 300 | 499 | Zinc stearate + Boron nitride | Compression | B | A |
| Example 6 | Open cells | 25 | 147 | Zinc stearate + Boron nitride | Melting | B | A |
| Example 7 | Open cells | 70 | 147 | Zinc stearate + Boron nitride | Melting | A | A |
| Example 8 | Open cells | 80 | 53 | Zinc stearate + Boron nitride | Melting | B | A |
| Example 9 | Open cells | 240 | 91 | Zinc stearate + Boron nitride | Melting | B | A |
| Example 10 | Open cells | 300 | 499 | Zinc stearate + Boron nitride | Melting | B | A |
| Example 11 | Open cells | 70 | 147 | Zinc stearate | Compression | A | B |
| Example 12 | Open cells | 70 | 147 | Zinc stearate | Melting | A | B |
| Example 13 | Open cells | 70 | 147 | Calcium stearate + Boron nitride | Compression | B | A |
| Example 14 | Open cells | 70 | 147 | Zinc stearate + Mica | Compression | A | B |
| Example 15 | Open cells | 15 | 137 | Zinc stearate + Boron nitride | Compression | C | A |
| Example 16 | Open cells | 320 | 520 | Zinc stearate + Boron nitride | Compression | C | A |

TABLE 1-continued

| | Foamed roller | | | Protective agent block | | Contamination | |
|---|---|---|---|---|---|---|---|
| | Cell type | Number of cells (per inch) | Hardness (N) | Composition | Molding method | Photoreceptor | Charging roller |
| Example 17 | Open cells | 80 | 34 | Zinc stearate + Boron nitride | Compression | C | A |
| Comparative Example 1 | Closed cells | 70 | 141 | Zinc stearate + Boron nitride | Compression | D | A |
| Comparative Example 2 | Closed cells | 80 | 55 | Zinc stearate + Boron nitride | Compression | D | A |
| Comparative Example 3 | Closed cells | 210 | 420 | Zinc stearate + Boron nitride | Compression | D | A |
| Comparative Example 4 | Closed cells | 70 | 141 | Zinc stearate + Boron nitride | Melting | D | A |
| Comparative Example 5 | Closed cells | 80 | 55 | Zinc stearate + Boron nitride | Melting | D | A |
| Comparative Example 6 | Closed cells | 210 | 420 | Zinc stearate + Boron nitride | Melting | D | A |

In each example, an image forming apparatus IMAGIO MP C5000 (from Ricoh Co., Ltd.) was used as a testing machine, and its brush roller and protective agent block were replaced with each foamed roller and protective agent block as shown in Table 1. The testing machine was put in a constant temperature chamber at 35° C., 85% RH for 10 days. Such a high-temperature and high-humidity condition can be regarded as an actual condition which causes temporal change to the protective agent applicator. After taken out of the constant temperature chamber, the testing machine continuously produced an A4-size vertically-striped pattern with an image occupation of 100% on 5,000 sheets of paper. Thereafter, the photoreceptor and the charging roller were visually observed to determine the degree of contamination.

The toner used in the examples had a circularity of 0.93 to 1.00. The circularity is defined as a ratio of a circumferential length of a circle having the same area as a projected image of a toner particle to the circumferential length of the projected image of the toner particle. The ratio (D4/D1) of the weight average particle diameter (D4) to the number average particle diameter (D1) of the toner was 1.00 to 1.40. The circularity and the ratio (D4/D1) were determined referring to the descriptions in Japanese Patent Application Publication No. 2010-164759, the disclosures thereof being incorporated herein by reference.

The mixture protective agent comprised of zinc stearate and boron nitride shown in Table 1 had a mixing rate of 95:5 (zinc stearate:boron nitride). To make the charging roller more easily contaminated, a worn cleaning blade was used in the experiments. The consumed amount of the protective agent block was set to 0.15 g/km by adjusting the pressing force from the pressing unit.

Figure 8:
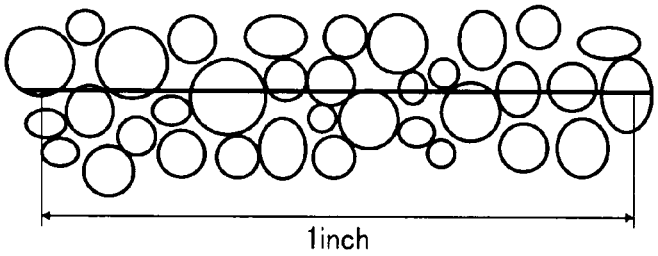
FIG. 8 is a partial magnified view of the foamed roller obtained by a microscope.

"Number of cells per inch" shown in Table 1 indicates the number of cells contacting 1 inch (i.e., about 25 mm) of a line drawn on the foamed layer. Each value shown in Table 1 is the average among 9 values measured at 3 portions on the foamed layer, i.e., both longitudinal end portions and a center portion, as illustrated in FIG. 7. The number of cells was determined from a photograph of each measured portion obtained with a microscope. Specifically, as illustrated in FIG. 8, a line having a length of 1 inch (i.e., about 25 mm) is drawn on near the center of the photograph and the number of cells contacting the line is visually counted. In the example illustrated in FIG. 8, the number of cells contacting the line is 12.

"Hardness" shown in Table 1 was the average hardness among several portions on the foamed layer. Hardness at each portion was measured based on a method according to JIS K 6400 (Flexible cellular polymeric materials—Determination of physical properties—).

The photoreceptor and charging roller were visually observed to determine the degree of contamination. In Table 1, the evaluation results are graded into the following four levels.

A: No contamination was observed.

B: Contamination was slightly observed but the resulting image was not contaminated.

C: Contamination was observed. The resulting image was slightly contaminated but acceptable for practical use.

D: Contamination was observed. The resulting image was also contaminated and not acceptable for practical use.

It is clear from Table 1 that Examples 1 to 17 using open-cell foamed rollers did not cause contamination to either the photoreceptor or charging roller very much, while Comparative Examples 1 to 6 using closed-cell foamed rollers caused unacceptable level of contamination to the photoreceptor. This is because the closed-cell foamed rollers had been plastically deformed in the high-temperature and high-humidity condition and they could not constantly supply the protective agent to the photoreceptor.

Examples 1 to 14 did not cause contamination to either the photoreceptor or the charging roller very much, while Examples 15 to 17 caused acceptable level of contamination to the photoreceptor. A comparison between Examples 1 to 5 and Examples 15 to 17 shows that there are an optimum number of cells and an optimum hardness for the open-cell foamed rollers. Specifically, when the number of open cells is 25 to 300 per inch and the hardness is 50 to 500 N, it is likely that the photoreceptor is not contaminated very much because a constant amount of the protective agent is uniformly supplied to thereto.

Examples 11 and 12 using zinc stearate as the protective agent and Example 14 using a mixture of zinc stearate and mica as the protective agent caused slight contamination to the charging roller. These results have arisen from the absence of boron nitride. Boron nitride is unlikely to be damaged by electrical stress and is capable of lubricate the charging roller by cleavage to prevent it from contamination.

In summary, in Examples 1 to 17, the photoreceptor and the charging roller are prevented from being contaminated with the spherical and small toner particles because the foamed rollers could constantly supply the protective agent to the photoreceptor without being plastically deformed and the protective agent was not damaged by electrical stress.

Additional modifications and variations of the present invention are possible in light of the above teachings. It is therefore to be understood that within the scope of the appended claims the invention may be practiced other than as specifically described herein.

What is claimed is:

1. A protective agent supply device, comprising:

a protective agent block including a metal salt of a fatty acid;

a rotatable foamed roller having a foamed layer having open cells, the foamed layer in contact with both the protective agent block and an outer peripheral surface of an image bearing member that bears a toner image, the foamed roller scraping the protective agent block and supplying the scraped protective agent to the outer peripheral surface of the image bearing member during rotation of the foamed roller; and a pressing unit that presses the protective agent block against the foamed roller.

2. The protective agent supply device according to claim 1, the foamed layer having the open cells in an amount of 25 to 300 per inch and a hardness of 50 to 500 N.

3. The protective agent supply device according to claim 1, further comprising a leveling member that evens out the protective agent on the outer peripheral surface of the image bearing member into a thin layer.

4. The protective agent supply device according to claim 1, the metal salt of a fatty acid being zinc stearate.

5. The protective agent supply device according to claim 1, the protective agent block further including an inorganic lubricant.

6. The protective agent supply device according to claim 5, the inorganic lubricant being boron nitride.

7. The protective agent supply device according to claim 5, wherein a mixing ratio of the metal salt of a fatty acid to the inorganic lubricant is 90/10 to 60/40.

8. The protective agent supply device according to claim 1, the protective agent block being formed by compression molding.

9. The protective agent supply device according to claim 1, the open cells being formed by compressing closed cells.

10. The protective agent supply device according to claim 1, the open cells being formed by a crushing process.

11. The protective agent supply device according to claim 1, the foamed roller being a polyurethane foam.

12. The protective agent supply device according to claim 11, the polyurethane foam being formed by mixing a polyol and polyisocyanate with additives to induce a foaming reaction.

13. The protective agent supply device according to claim 1, the foamed roller being formed by pouring raw materials in a mold within which a core material is set, and subjecting the raw materials to foaming.

14. The protective agent supply device according to claim 13, the raw materials of a polyurethane foam being mixed with at least one of a cross-linking agent or a foam breaker.

15. The protective agent supply device according to claim 1, further comprising an elastic layer integrally formed with a shaft being formed by a cylindrical metal mold within which cylindrical metal mold the shaft is set coincident with the cylindrical metal mold axis, the cylindrical metal mold is filled with raw materials of a polyurethane foam, the cylindrical metal mold is subjected to heat to harden the raw materials of a polyurethane foam, and the resulting elastic layer integrally formed with the shaft is demolded.

16. A process cartridge, comprising:

a main body;

an image bearing member pivotally supported by the main body;

a charger that charges an outer peripheral surface of the image bearing member;

a developing device that develops an electrostatic latent image formed on the outer peripheral surface of the image bearing member into a toner image; and a protective agent supply device, including:

a protective agent block including a metal salt of a fatty acid;

a rotatable foamed roller having a foamed layer having open cells, the foamed layer in contact with both the protective agent block and the outer peripheral surface of the image bearing member, the foamed roller scraping the protective agent block and supplying the scraped protective agent to the outer peripheral surface of the image bearing member during rotation of the foamed roller; and a pressing unit that presses the protective agent block against the foamed roller.

17. The process cartridge according to claim 16, further comprising a cleaning device that removes residual toner particles remaining on the outer peripheral surface of the image bearing member without being transferred.

18. An image forming apparatus, comprising the process cartridge according to claim 16.

19. An image forming apparatus, comprising:

an image bearing member;

a charger that charges an outer peripheral surface of the image bearing member;

a developing device that develops an electrostatic latent image formed on the outer peripheral surface of the image bearing member into a toner image; and a protective agent supply device, including:

a protective agent block including a metal salt of a fatty acid;

a rotatable foamed roller having a foamed layer having open cells, the foamed layer in contact with both the protective agent block and the outer peripheral surface of the image bearing member, the foamed roller scraping the protective agent block and supplying the scraped protective agent to the outer peripheral surface of the image bearing member during rotation of the foamed roller; and a pressing unit that presses the protective agent block against the foamed roller.

20. The image forming apparatus according to claim 19, further comprising a cleaning device that removes residual toner particles remaining on the outer peripheral surface of the image bearing member without being transferred.

* * * * *